US006866312B1

(12) United States Patent
Rhyneer

(10) Patent No.: US 6,866,312 B1
(45) Date of Patent: Mar. 15, 2005

(54) SHOCK-ACTUATED LOCK WITH RESETABLE BALL

(76) Inventor: George S. Rhyneer, 10500 Old Eagle River Rd., Eagle River, AK (US) 99577

( * ) Notice: Subject to any disclaimer, the term of this patent is extended or adjusted under 35 U.S.C. 154(b) by 41 days.

(21) Appl. No.: 10/619,404

(22) Filed: Jul. 14, 2003

(51) Int. Cl.[7] ..... E05C 19/02
(52) U.S. Cl. ..... 292/252; 292/251.5; 292/DIG. 22; 292/DIG. 65
(58) Field of Search ..... 292/251.5, 252, 292/183, 230, DIG. 22, DIG. 65

(56) References Cited

U.S. PATENT DOCUMENTS 2,693,615 A * 11/1954 Hatke ..... 16/83
4,714,286 A * 12/1987 Yamamoto ..... 292/252
5,152,562 A * 10/1992 Stevenson et al. ..... 292/252
5,518,282 A * 5/1996 Sawada ..... 292/252
5,597,188 A * 1/1997 Miche ..... 292/DIG. 22
5,611,579 A * 3/1997 Kreitenberg ..... 292/DIG. 65
5,697,655 A * 12/1997 Strong ..... 292/DIG. 22
6,550,827 B1 * 4/2003 Tsujino ..... 292/252
6,561,555 B1 * 5/2003 Millard ..... 292/251.5
6,588,811 B1 * 7/2003 Ferguson ..... 292/251.5

* cited by examiner

*Primary Examiner*—Daniel P. Stodola
*Assistant Examiner*—Christopher Boswell
(74) *Attorney, Agent, or Firm*—Michael J. Tavella

(57) ABSTRACT

A lock for earthquakes that securely holds a door closed when an earthquake strikes, but it otherwise out of the way during normal use. It consists of a steel ball that is positioned at the top of an angled ramp. A magnet is embedded on the inside surface of the door, where it is invisible under normal use. When an earthquake strikes, the steel ball drops and contacts the magnet. At this point, the door is effectively locked. The system is designed so that the magnet is strong enough to securely hold the door closed, but can be easily overcome to open the door after the event is over. Once the event is over, the system can be reset by pulling the door open with enough force to overcome the magnet and placing the ball back up into its ready position. When closed, the cabinets appear to be perfectly normal.

16 Claims, 6 Drawing Sheets

SHOCK-ACTUATED LOCK WITH RESETABLE BALL

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the Invention

This invention relates to earthquake locks for cabinets and particularly to earthquake locks for cabinets using magnetic latches.

2. Description of the Prior Art

Earthquakes have been a part of the world since the beginning of time. They are cause of much destruction. Most earthquakes however are not catastrophic events. These minor earthquakes may still cause damage as items are thrown off shelves and contents of closed cabinets are discharged into the room. Not much can be done to protect items stored on open shelves. However, closed cabinets have doors that, if they were to remain closed in an earthquake would prevent a lot of incidental damage. To that end, several types of "earthquake lock" have been invented that allow normal use of cabinets under ordinary circumstances, but act to lock the cabinets doors shut in the event of seismic activity. U.S. Patents that address this problem are U.S. Pat. Nos. 5,152,562 and 5,518,282. U.S. Pat. No. 5,152,562 teaches a device that uses a ball that is held in an elevated position in a housing. At the base of the housing is a latch that attaches to the inside of a cabinet door. The latch has a slot cut into it such that when the door is closed, the slot is positioned under the ball. When an earthquake strikes, if the force is sufficient, it causes the ball to be pushed from its resting position and down into the slot. This then prevents the door from opening and spilling the contents of the cabinet. Although this system appears to work, it has several problems. First, the ball is set in a recess. Although the sensitivity of the device can be adjusted, it can take considerable force to cause the ball to drop. Second, the latch with the slot is attached to the door. If the movement that causes the ball to fall also causes the door to fly open, the ball will not fall into the slot. If the door has opened widely enough, it may even block the door from closing again. Finally, once the lock is set, there is no way to open the cabinet again. The patent teaches securing a string that passes through the side of the cabinet so that a user can pull the ball back up so that the door can be opened.

U.S. Pat. No. 5,518,282 teaches a system that keeps a door or drawer locked all the time. In this way, an earthquake cannot cause the door to open. Moreover, because the door is locked al the time, there is no need for a system to cause the door to be locked, with the inherent possibility of the failure of the system. The patent uses a hooked shaped latch that hooks onto a ledge attached to the door. There is a release mechanism provided that allows the door to be opened for ordinary use. While this device eliminates the need for a device to lock the door in the event of an earthquake, it has the problem of prevent easy access to the contents of the cabinets. Because earthquakes rarely occur but accessing the cabinets is a daily occurrence, this system rapidly becomes a nuisance.

Two systems have been developed in Japan as well. JP9067970A2 and JP9078926A2 use balls to engage latches to prevent doors from opening in the event of an earthquake. JP9067970A2 teaches a system similar to U.S. Pat. No. 5,152,562 in that a ball is designed to drop into a bracket with a slot, which is attached to the door. JP9078926A2 teaches a system in which a ball drop down and engages a spring mechanism that causes two pins to laterally move into holes drilled in the doors. Once the pins are in place, the doors will not open. These systems suffer from the same problem as discussed above: if the doors are open at the same time the ball drops, the ball does not align with the slot in the bracket in the first case, or what is worse, the pins will not align with the holes in the doors in the latter case. This is worse because one the pins have been deployed, the doors will not close fully. Thus, when the next jolt hits, the doors may be flung open, with the locks having no effect.

BRIEF DESCRIPTION OF THE INVENTION

The instant invention solves all of these problems. It is a lock for earthquakes that securely holds a door closed when an earthquake strikes, but it otherwise out of the way during normal use. It consists of a steel ball that is positioned at the top of an angled ramp. A magnet is embedded on the inside surface of the door, where it is invisible under normal use. When an earthquake strikes, the steel ball drops and contacts the magnet. At this point, the door is effectively locked. The system is designed so that the magnet is strong enough to securely hold the door closed, but can be easily overcome to open the door after the event is over. Moreover, unlike the other designs, if the door should open as the ball is dropping, the magnet will engage the ball as soon as it closes. There is no problem with alignment. In this way, the system is simple and effective. Once the event is over, the system can be reset by pulling the door open with enough force to overcome the magnet and placing the ball back up into its ready position. There is no need for strings that penetrate the cabinets or for large latches attached to the door. When closed, the cabinets appear perfectly normal. When the door is open, the only thing a user sees is a small magnet inlaid into the door and the ball and ramp.

It is an object of the invention to produce an earthquake lock for cabinet doors that allows normal operation of the doors during ordinary use.

It is another object of the invention to produce an earthquake lock for cabinet doors that does not require a mechanism for resetting the lock after an event.

It is yet another object of the invention to produce an earthquake lock for cabinet doors that does not incorporate intrusive components that are attached to the cabinet door.

DETAILED DESCRIPTION OF THE INVENTION

Figure 1:
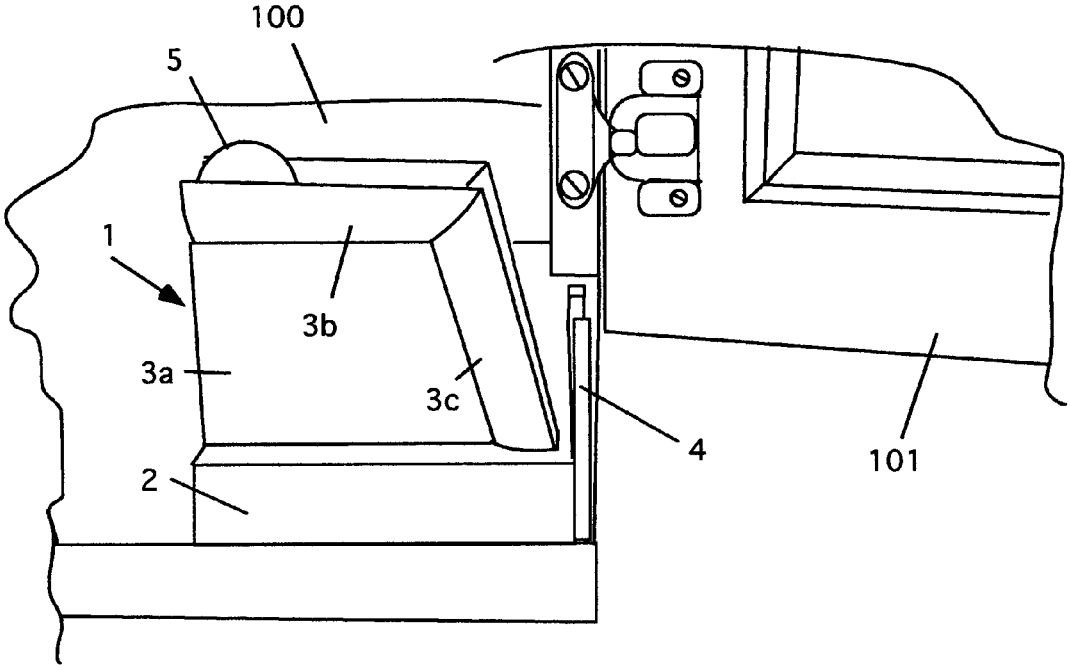
FIG. 1 is a partial side view of the interior of a cabinet with the invention installed and with the ball in the ready position.

Referring now to FIG. 1, a partial side view of the interior of a cabinet 100 is shown. Here, the device 1 is shown installed. The device 1 consists of a base plate 2, a ramp 3 and a stop plate 4. The ramp 3 has three main parts. The first is an elevation block 3*a*, the second is the upper ramp 3*b* and the third is the vertical ramp 3*c*. Note that in the preferred embodiment, the vertical ramp portion 3*c* is set at a slight back angle to ensure a smooth ball drop. In the preferred embodiment, a plurality of ribs 3*d* (see FIG. 6) are used to hold the ball in place in the upper ramp 3*b*. A ball 5 is shown in place in the upper ramp 3*b*. A stop plate 4 is positioned at the front of the device and is secured into the base using common fasteners (on the other hand, the entire unit can be made of plastic or light non-ferrous metal, if desired).

Figure 2:
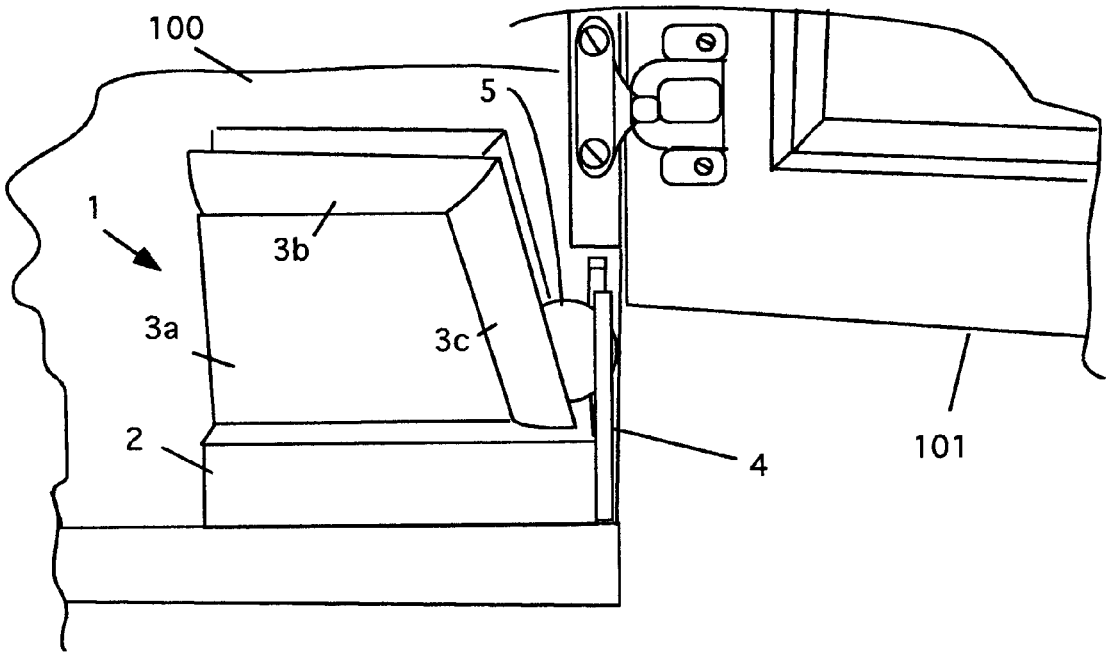
FIG. 2 is a partial side view of the interior of a cabinet with the invention installed and with the ball in the lock position.

FIG. 2 shows the same view as FIG. 1, with the ball 5 at the base of the vertical ram 3*c*. Here, the stop plate 4 is shown retaining the ball in the device.

Figure 3:
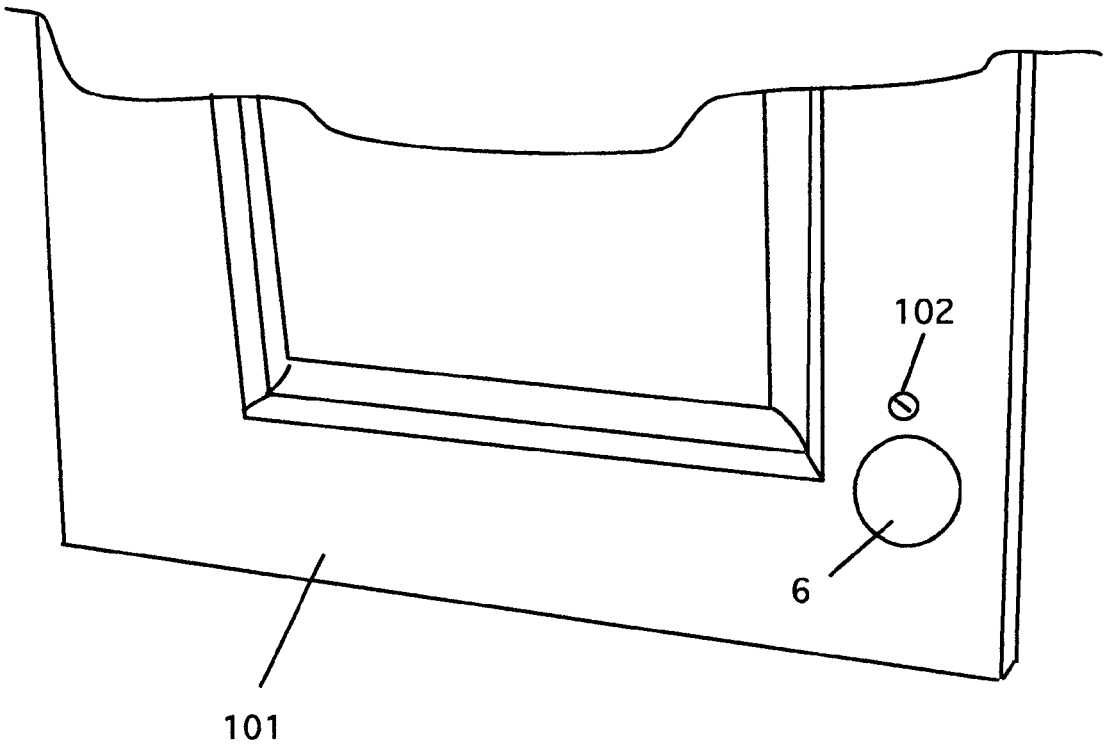
FIG. 3 is a partial view of the inner surface a cabinet door showing a magnet inlaid therein.

FIG. 3 shows the inside face of a door 101. A magnet 6 is installed in the door 101. In the preferred embodiment, the magnet is inlaid in the door to provide a smooth, pleasing appearance. Note the pull handle screw 102 is shown just above the magnet.

Figure 4:
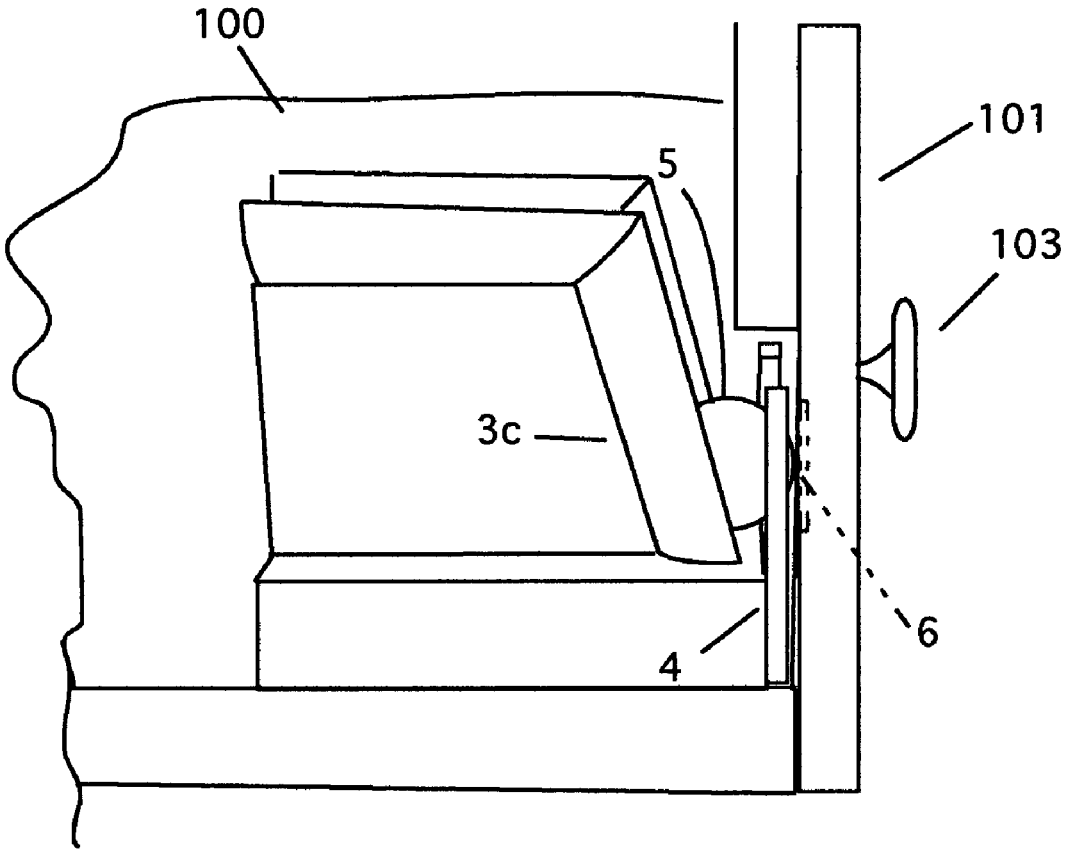
FIG. 4 is a partial side view of the interior of a cabinet with the invention installed showing the ball down and the door locked.

FIG. 4 shows the magnet in the lock position and the door 101 closed. Here, the magnet 6 (shown in dashed lines) is pressed against the ball 5. In this position, the door is held shut by a significant force. However, it is possible to overcome this force by pulling on the pull handle 103. FIG. 2 shows the position of the components after the door is opened. In the preferred embodiment, the ball 5 is repositioned by pushing the ball back up to the top ramp 3*b*. This is a simple way of resetting the door without having to use complicated strings to spring reset features.

Figure 5:
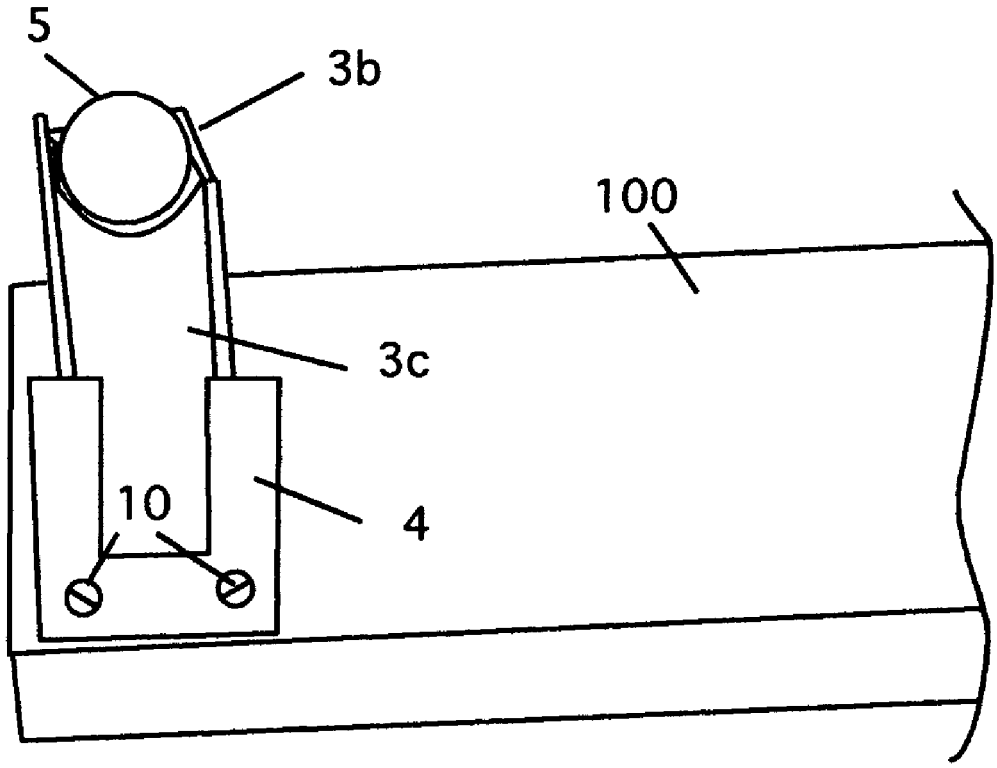
FIG. 5 is a front detail view of the track showing the ball in the ready position.
Figure 6:
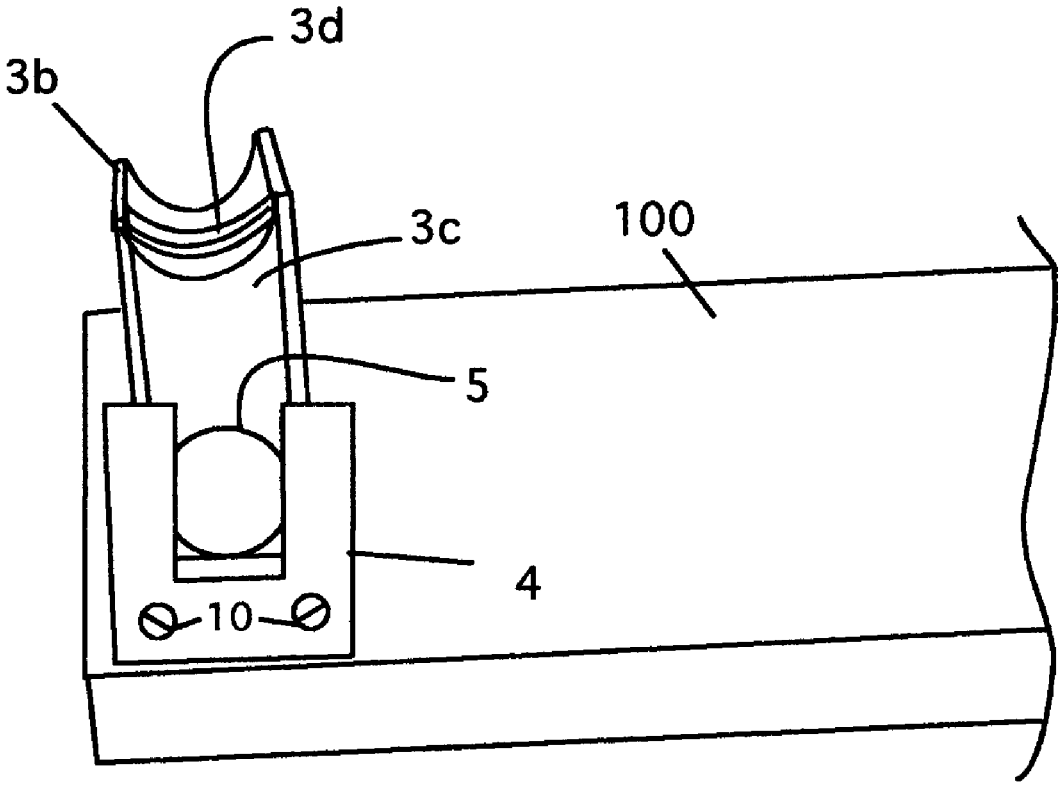
FIG. 6 is a front detail view of the track showing the ball in the lock position.

FIGS. 5 and 6 show front view of the device with the ball in the ready position and in the lock position. Here, the stop plate 4 is clearly shown. The plate has an open center that allows the ball to protrude slightly past the stop plate (see FIG. 2). These figures also show the fasteners 10 that secure the stop plate to the base 2. FIG. 6 shows the ribs 3*d* used to provide a frictional surface to hold the ball in place at the top of the ramp. Of course, other means may be used to hold ball in the ready position. The only criteria are that the ball remains in place in the ready position during ordinary use and that the ball is free to drop when a sufficient shaking force is experienced. The ribs 3*d* can be considered as a means for retaining said ball in said upper portion of the ramp. The ribs create a frictional force that can be defined as creating a threshold of motion, below which, the ball 5 is held motionless in said upper portion of the ramp. Above the threshold of motion, the ball overcomes the frictional force and is then able to move in ramp until it falls to the bottom of the ramp. A moderate earthquake should have enough force to overcome the threshold of motion.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A shock-actuated lock comprising:

a) a ramp, said ramp having an upper portion and a lower portion, and further wherein the upper portion being in a horizontal plane and further wherein the lower portion being in a vertical plane, said lower portion also having a bottom, said ramp being positioned adjacent to a movable object;

b) a ball, movably installed on said ramp, said ball having a quantity of a ferrous material therein;

c) a means for retaining said ball in said upper portion of said ramp, said means for retaining having a threshold of motion, below which said ball is held motionless in said upper portion of said ramp and, above which said ball becomes free to move in said ramp;

d) a means for retaining said ball at the bottom of said lower portion of said ramp; and e) a magnet, secured to a cabinet door and being positioned in alignment with the bottom of said lower portion of said ramp, such that when the ball is held at the bottom of said lower portion of said ramp, the magnet is attracted to said ball by an attractive force, such that the cabinet door is held closed.

2. The lock of claim 1 wherein the ramp is mounted in a cabinet.

3. The lock of claim 1 wherein the movable object is a cabinet door.

4. The lock of claim 3 wherein the cabinet door is hingeably attached to the cabinet.

5. The lock of claim 1 wherein the means for retaining said ball in said upper portion of said ramp comprise a plurality of ribs, formed in said upper portion of said ramp.

6. The lock of claim 1 wherein the means for retaining said ball at the bottom of said lower portion of said ramp comprises a plate, secured to the bottom of said lower portion of said ramp.

7. The lock of claim 6 wherein the plate has an opening formed therein.

8. The lock of claim 1 wherein the cabinet door has a means for overcoming the attractive force of said magnet.

9. The lock of claim 8 wherein the means for overcoming the attractive force of said magnet comprises a door pull, attached to said door.

10. A shock-actuated lock comprising:

a) a ramp, said ramp having an upper portion and a lower portion, and further wherein the upper portion being in a horizontal plane and further wherein the lower portion being in a vertical plane, said lower portion also having a bottom, said ramp being positioned inside a cabinet adjacent to a cabinet door;

b) a ball, movably installed on said ramp, said ball having a quantity of a ferrous material therein;

c) a means for retaining said ball in said upper portion of said ramp, said means for retaining having a threshold of motion, below which said ball is held motionless in said upper portion of said ramp and, above which said ball becomes free to move in said ramp;

d) a means for retaining said ball at the bottom of said lower portion of said ramp; and e) a magnet, secured to said cabinet door and being positioned in alignment with the bottom of said lower portion of said ramp, such that when the ball is held at the bottom of said lower portion of said ramp, the magnet is attracted to said ball by an attractive force, such that the cabinet door is held closed.

11. The lock of claim 10 wherein the cabinet door is hingeably attached to the cabinet.

12. The lock of claim 10 wherein the means for retaining said ball in said upper portion of said ramp comprise a plurality of ribs, formed in said upper portion of said ramp.

13. The lock of claim 10 wherein the means for retaining said ball at the bottom of said lower portion of said ramp comprises a plate, secured to the bottom of said lower portion of said ramp.

14. The lock of claim 13 wherein the plate has an opening formed therein.

15. The lock of claim 10 wherein the cabinet door has a means for overcoming the attractive force of said magnet.

16. The lock of claim 15 wherein the means for overcoming the attractive force of said magnet comprises a door pull, attached to said door.

* * * * *